United States Patent [19]

Barrash

[11] 4,322,016

[45] Mar. 30, 1982

[54] PROOF-OF-PURCHASE MEANS FOR SELF-OPENING CANS

[75] Inventor: Marshall J. Barrash, Atlanta, Ga.

[73] Assignee: The Coca-Cola Company, Atlanta, Ga.

[21] Appl. No.: 65,420

[22] Filed: Aug. 10, 1979

[51] Int. Cl.[3] ..... B65D 41/32; B21D 51/38

[52] U.S. Cl. ..... 220/270; 40/307; 206/459; 220/269; 413/12

[58] Field of Search ..... 220/269–273; 206/459; 40/306, 307, 2, 10; 229/7 R

[56] References Cited

U.S. PATENT DOCUMENTS 3,836,038 9/1974 Cudzik ..... 220/269

3,952,912 4/1976 Perry ..... 220/269

3,958,354 5/1976 Hough et al. ..... 40/307

4,171,085 10/1979 Doty ..... 206/459 X

*Primary Examiner*—George T. Hall

*Attorney, Agent, or Firm*—Birch, Stewart, Kolasch & Birch

[57] ABSTRACT

A pressure-sensitive proof-of-purchase label is transferably affixed to the undersurface of an opening lever of a self-opening can such that the label is inaccessible without actuating the lever to open the can. The label, after opening the can, is transferable to a storage surface for subsequent use or redemption. The label is applied in a continuous process to the lever arm after it is formed and prior to riveting the lever arm to a can end.

2 Claims, 2 Drawing Figures

PROOF-OF-PURCHASE MEANS FOR SELF-OPENING CANS

FIELD OF THE INVENTION

The present invention relates to proof-of-purchase devices for self-opening cans and more particularly, to pressure sensitive adhesive type proof-of-purchase labels associated with lever arm style non-detachable opening devices on can lids.

BACKGROUND OF THE INVENTION

In self-opening cans in which a lever arm style non-detachable opening device is provided, the basic concept common to these devices is that a lever arm is lifted to break through a scored circular or oblong opening area to provide access to the interior of the can. This opening action is completed when the lever arm is lifted from the horizontal position to a vertical or slightly beyond vertical position.

It is an object of this invention to provide a new and novel combination of a proof-of-purchase label and lever arm for self-opening cans wherein the label is applied to the underside of a lever arm with a pressure sensitive adhesive prior to the attachment, such as by riveting, of the lever arm to the end of a can adjacent a scored circular or oblong opening area thereon.

Another object of the present invention is to provide a new and novel self-opening can end assembly comprising a proof-of-purchase label on the underside of a lever arm on the self-opening can end which is inaccessible until the lever arm has been lifted sufficiently to cause a breakthrough of the scored opening area thereby rupturing the seal on an associated can.

Yet another object of the present invention is to provide a new and novel method of attaching a proof-of-purchase label, which may contain proof-of-purchase and/or gaming information or the like to a self-opening can end assembly.

These and other objects of the present invention will become more fully apparent with reference to the following specification and drawing which relate to a preferred embodiment of the present invention.

SUMMARY OF THE INVENTION

A proof-of-purchase label coated with pressure sensitive adhesive is applied to the underside of the lever arm of a self-opening can prior to the riveting of the lever arm to the end of the can adjacent a prescored circular or oblong area defining an opening therein. In the formation of a lever arm of the type used for self-opening cans, lever arm sheet metal stock is fed into a press where the lever arm is formed from a series of suitable reciprocating dies and thence to a riveting station where it is attached to a preformed can end. In the present situation, an additional work station is placed between the outlet of the forming dies and the riveting station such that pressure-sensitive adhesive backed label material comprising the present invention can be attached to the underside of the lever arm just prior to riveting.

Thus, the present invention provides a proof-of-purchase or premium label which can be viewed by the user of the can's product only after the scored area is broken open by elevation of the lever arm on the can to the can opening position. The proof-of-purchase is easily removable and then transferable to a piece of paper or coupon book via its pressure sensitive adhesive backing for later redemption by the customer. Furthermore, the position of the proof-of-purchase label beneath the lever arm and between the lower surface of the lever arm and the can end provides for protecting the proof-of-purchase label from scuffing or loss of adhesion. Furthermore, by manufacturing the lever arms, can ends and labels as a unit, the integrity of the adhesive bond in a moisture-free environment between the lever-arm and the adhesive backed proof-of-purchase label will be insured.

DETAILED DESCRIPTION OF THE DRAWINGS

Figure 1:
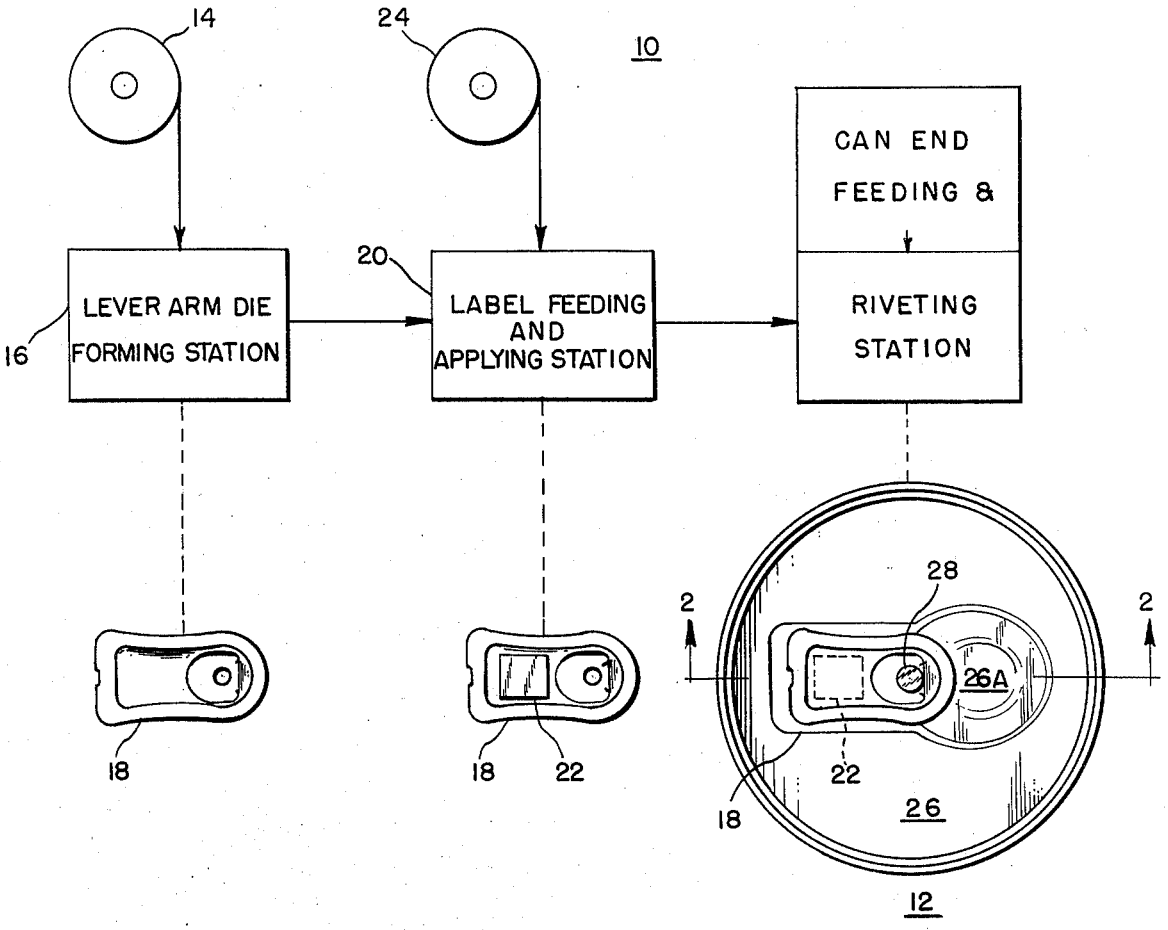
FIG. 1 illustrates a basically three-stage, lever arm forming, label applying, and lever-arm-to-can-end riveting manufacturing process in schematic form with the end product of the present invention, namely, the adhesively applied proof-of-purchase label in combination with the lever arm and can end assembly being illustrated in top plan view.
Figure 2:
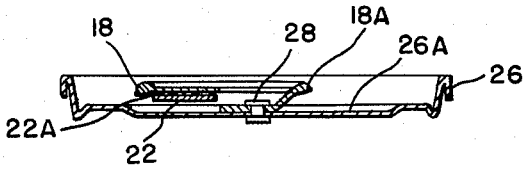
FIG. 2 is a cross-section of the finished product taken along line 2—2 of FIG. 1.

Referring in detail to the drawings and with particular reference to FIGS. 1 and 2, a manufacturing system 10 for the can end assembly 12 of the present invention is shown as including a roll of lever arm stock 14 feeding into a lever arm die forming station 16 to produce a sequence of lever arms 18 which are fed therefrom to a label feeding and applying section 20.

The label feeding and applying station 20 receives a series of proof-of-purchase labels 22 from a roll of label stock 24 which includes a pressure sensitive adhesive backing illustrated as 22A in FIG. 2 by which the proof-of-purchase label 22 is adhered to the undersurface of the lever arm 18.

The combined label 22 and the lever arm is fed to a can end feeding and riveting station wherein the lever arm is placed such that the label 22 is between the lever arm 18 and can end blank 26, which can end blank includes a prescored area 26A adjacent to which the lever arm 18 is to be riveted.

The lever arm 18 is riveted by means of a rivet 28 from the can end 26 through the lever arm 18 such that the rivet 28 provides a fulcrum, in a manner known in the art, about which the actuating or opening tip 18 of the lever arm can pivot to engage the prescored opening area 26A of the can end to cause it to rupture and open the can end to provide access to an associated can when the other end of the lever arm 18 beneath which the proof-of-purchase label 22 is adhered is lifted to a vertical or past vertical position.

As can be seen from the foregoing specification and drawings, the proof-of-purchase label 22, which may also be a premium label, gaming type label or any other suitable printed matter bearing label, is completely protected from access by unauthorized persons until such time as a can end 26 with which it is associated is opened by the associated lever arm 18.

By pre-applying the label 22 at a point in the manufacturing process of a can end assembly 12, the initial adherance of the label takes place in a substantially moisture free environment to insure maximum integrity of the adhesive bond provided by the pressure sensitive adhesive 22A.

Furthermore, by the fact that lever arm 18 overlays and protects the adhesively applied proof-of-purchase label 22, that label is protected against scuffing or loss of adhesion by virtue of the fact that it is sandwiched snugly between two pieces of metal constituted by the lever arm 18 and the upper surface of the can end 26. This construction makes the label 22 substantially pilfer-proof.

Once a can is opened by raising the lever arm 18 or pivoting same about the rivet 28 to raise the lever arm 18 to a vertical or past vertical position, the pressure-sensitive label 22 can be removed from the back or hidden side of the lever arm 18 and transferred to a coupon book or piece of paper or other surface where it may be saved for later use and/or redemption.

Thus it can be seen that the present invention provides a proof-of-purchase label in combination with a self-opening can end assembly which, when actuated to open a can with which that can end is associated, can be removed and placed on a storage surface such as a coupon collection book or the like for subsequent or later use and/or redemption.

It should be understood that the proof-of-purchase means for self-opening cans may be modified as would occur to one of ordinary skill in the art without departing from the spirit and scope of the present invention.

It is claimed:

1. In a can end assembly for self-opening cans, which assembly includes a can end having a prescored opening area, and a lever arm riveted adjacent thereto having a finger engageable actuating end and a prescored area engaging opening end, the improvement comprising:

a proof-of-purchase label means including a pressure sensitive adhesive backing affixed beneath the actuating end of said lever arm by said adhesive backing;

said label means being inaccessible for removal until said lever arm is actuated to open said prescored area; and said label means being removable from said lever arm and transferrable to a storage surface pending further use or redemption thereof.

2. The method of affixing a pressure sensitive adhesive label in an inaccessible manner to the underside of a lever arm in a self-opening can end assembly having a prescored opening are comprising:

forming a pressure sensitive label and adhering it to a surface of said lever arm adjacent one end thereof;

sandwiching said label between said lever arm and a can end at a point adjacent a prescored opening area in said can end; and riveting said lever arm to said can end intermediate its ends, with an end of said lever arm overlapping said prescored area and said one end of said lever arm bearing said label outboard of said prescored area.

* * * * *